US006086320A

United States Patent [19]

Wilbers et al.

[11] Patent Number: 6,086,320

[45] Date of Patent: Jul. 11, 2000

[54] STACKING APPARATUS

[75] Inventors: Arno Antonius Bernardus Wilbers, Denekamp, Netherlands; Eberhard Falch, Bückeburg, Germany

[73] Assignee: Universal Corrugated B.V., Almelo, Netherlands

[21] Appl. No.: 09/125,915

[22] PCT Filed: Feb. 26, 1997

[86] PCT No.: PCT/NL97/00088

§ 371 Date: Nov. 12, 1998

§ 102(e) Date: Nov. 12, 1998

[87] PCT Pub. No.: WO97/31850

PCT Pub. Date: Sep. 4, 1997

[30] Foreign Application Priority Data

Feb. 28, 1996 [NL] Netherlands ..... 1002470

[51] Int. Cl.[7] ..... B65G 57/00

[52] U.S. Cl. ..... 414/789; 414/792.6

[58] Field of Search ..... 414/789, 790.3, 414/792.6, 799, 792.7

[56] References Cited

U.S. PATENT DOCUMENTS

| | | | |
|---|---|---|---|
| 2,672,079 | 3/1954 | Chandler . | |
| 2,852,990 | 9/1958 | Roe | 414/789 |
| 3,995,540 | 12/1976 | Huiskes . | |
| 4,367,997 | 1/1983 | Schweingruber | 414/790.3 |
| 4,988,264 | 1/1991 | Winski | 414/796.8 |
| 5,433,582 | 7/1995 | Medina | 414/790.3 |
| 5,829,951 | 11/1998 | Adami | 414/789 |

FOREIGN PATENT DOCUMENTS

| | | |
|---|---|---|
| 4013166 | 10/1990 | Germany . |
| 2060571 | 5/1981 | United Kingdom . |

*Primary Examiner*—Gregory A. Morse

*Attorney, Agent, or Firm*—Webb Ziesenheim Logsdon Orkin & Hanson, P.C.

[57] ABSTRACT

A stacking apparatus for successively supplying boards and forming stacks of these boards and ordering these stacks in chosen patterns having: a feed conveyor for successively supplying boards; a stacking station connecting onto the end of the feed conveyor and having a supporting base and a stop for bringing to a standstill the boards supplied by the feed conveyor such that a stack of boards may be brought to a standstill until the thus formed stack has reached a desired height, the stop is subsequently moved from the front surface of the stack to the rear surface of the stack and from this position displaces the stack by pushing over the supporting base to a position in which the rear surface of the stack lies beyond the initial position of the front surface or in which the stack lies with its front surface against the rear surface of a previously formed stack; and a discharge device is present for removing formed stacks from the supporting base.

9 Claims, 4 Drawing Sheets

STACKING APPARATUS

BACKGROUND OF THE INVENTION

1. Field of the Invention

The invention relates to a stacking apparatus for successively supplying boards, for instance identical sheets of cardboard, and forming stacks of these boards and ordering these stacks in chosen patterns.

2. Description of the Prior Art

Once such prior art apparatus has:

a feed conveyor for successively supplying boards individually, in overlapping relation or in part-stacks;

a stacking station connecting onto the end of the feed conveyor and having a supporting base and a stop extending vertically and perpendicularly of the transporting direction of the feed conveyor for bringing to a standstill the boards supplied by the feed conveyor such that a stack of boards supported by the supporting base is formed; and discharge means for discharging a stack from the supporting base.

Such a stacking apparatus is known in diverse embodiments. For forming of stacks and ordering of these stacks in chosen patterns stations are required which are functionally and actually separated from each other. This makes a stacking apparatus of the known type expensive, while the known apparatus also takes up a relatively large amount of space.

It is an object of the invention to embody a stacking apparatus such that it can be constructed relatively inexpensively and take up relatively little space.

BRIEF SUMMARY OF THE INVENTION

This objective is realized with a stacking apparatus of the stated type which has the feature that the supporting base has an effective dimension in the transporting direction amounting to more than twice the dimension of the boards in the transporting direction;

the stop is drivable by drive means such that in a stationary stop position it can bring the supplied boards to a standstill until the thus formed stack has reached a desired height, is subsequently moved from the front surface of the stack to the rear surface of the stack and from this position displaces the stack by pushing over the supporting base to a position in which the rear surface of the stack lies beyond the initial position of the front surface or in which the stack lies with its front surface against the rear surface of a previously formed stack; and discharge means are present for removing formed stacks from the supporting base.

A preferred embodiment has the special feature that means are added to the feed conveyor which temporarily interrupt the supply of boards to the stacking station during the movement of the stop.

An embodiment has the special feature that the stop comprises a flat plate.

The supporting base can be wholly flat but, with regard to particular requirements which may be made, may have a profiled pattern. It may occur in this latter case that the bottom board or boards of a stack are not stopped in correct manner by the stop. In this respect an embodiment can have the feature that the stop has a form adapted to the form of the supporting base, in particular has a form complementary thereto.

A specific embodiment has the feature that the supporting base is the active part of the conveyor which can discharge in transverse direction the stacks present thereon.

This latter variant can be embodied such that the conveyor comprises slats hingedly coupled to each other. The slats extend in the transporting direction of the feed conveyor. They are mutually connected in the manner of links of a chain or are supported by chains constructed from links.

A specific embodiment of this latter variant has the special feature that the slats each have a convex prismatic upper surface. It is noted that "prismatic" means that the cross section has the same shape at any longitudinal position.

Yet another embodiment has the special feature that the conveyor comprises a driven roller track.

This variant provides the option of the stop comprising at least two elongate elements extending between the rollers. Such a variant can have the advantage that the stop does not necessarily have to be movable over the formed stack but can also be retracted below the conveyor to be moved to the pushing position. This can be an advantage depending on the space available.

BRIEF DESCRIPTION OF THE DRAWINGS

The invention will now be elucidated with reference to the annexed drawings. Herein.

DETAILED DESCRIPTION OF THE INVENTION

Figure 1:
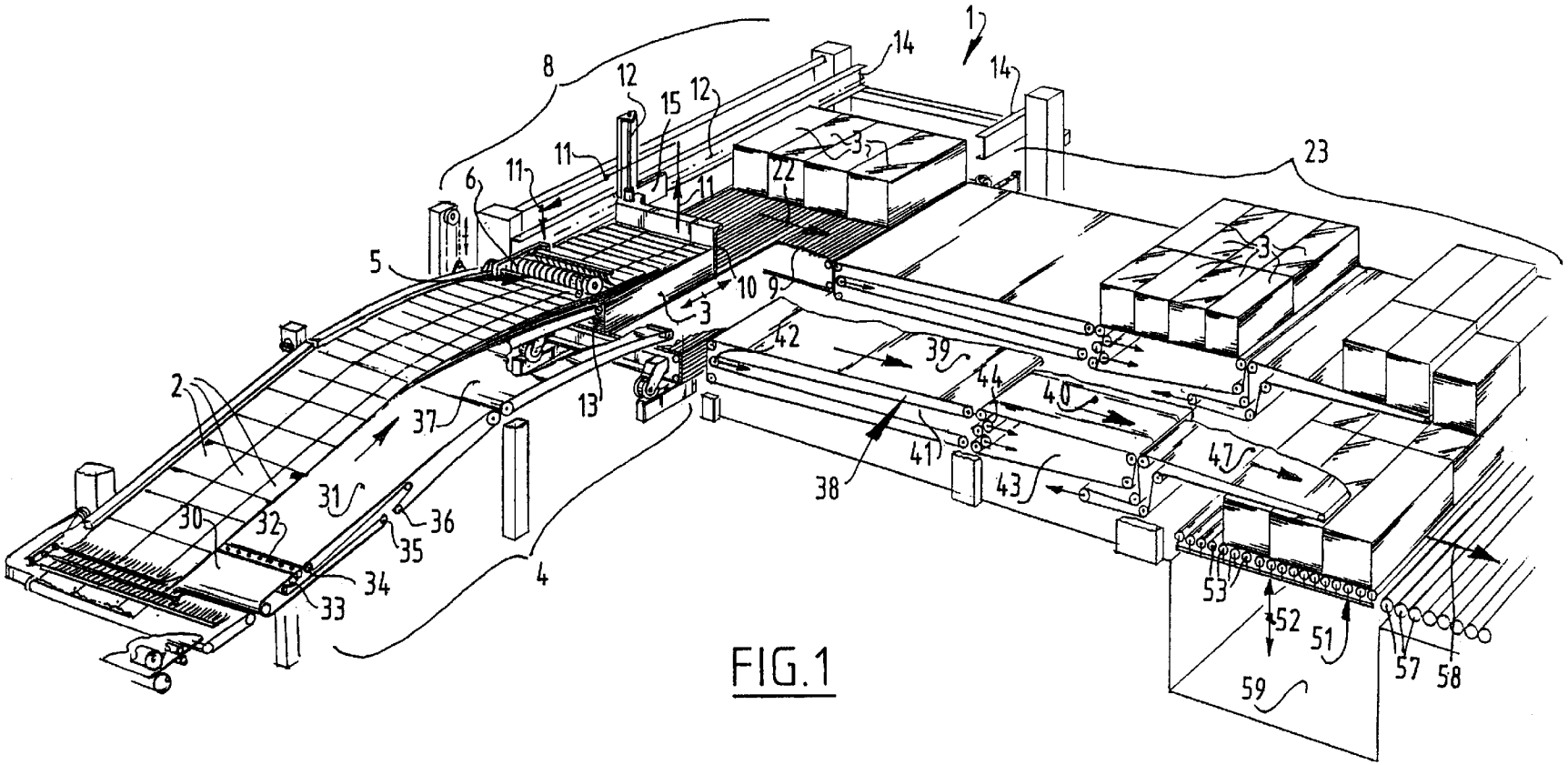
FIG. 1 shows a partly schematic, broken away perspective view of a stacking and forming apparatus.

FIG. 1 shows an apparatus 1 for successively supplying boards 2 and forming stacks 3 thereof. Boards 2 are supplied by a feed conveyor 4 in four mutually adjacent rows such that the boards of each row are mutually overlapping.

The feed conveyor has at its discharge end a delivery device 5 comprising a driven roller 6 built up of part-rollers and a brush 7 which is placed downstream relatively thereof and which can serve to press a passing board 2 lightly downward.

Connecting to the end of feed conveyor 4 is the infeed end of a stacking station 8. This supply station 8 comprises a supporting base embodied as an endless conveyor 9 and a flat stop plate 10 extending vertically and perpendicularly of the transporting direction of feed conveyor 4 for bringing to a standstill the boards 2 supplied by feed conveyor 4 such that a stack 3 of boards 2 carried by the supporting base 9 is formed.

As designated with arrows 11, the stop plate 10 can be moved vertically upward by an XY drive after a desired height of the formed stack has been reached, whereafter plate 10 is moved over the formed stack and then displaced downward to the rear surface 13 of the formed stack after sufficient space has been created, insofar as necessary, by optional displacement of the end zone of feed conveyor 4 to allow the plate 10 access to the rear surface 13. The front surface of stack 3, the flatness of which is determined by the flatness of the stop plate 10 in the initially stationary position, is now free. By driving longitudinal guides 14 of the carriage 15 forming part of the XY drive 12, the formed stack is now pushed over a distance greater than the dimension in the transporting direction of the formed stack 3. The stacks are for instance pushed to the position shown in FIG. 1 in which the four simultaneously formed stacks are situated at the rear of the endless conveyor 9. The term "rear" must in the first instance be understood to mean the end in the transporting direction described heretofore. After pushing as described, the stop plate 10 is transported again to its position as shown in FIG. 1 by moving back the carriage 15. In this stationary position it serves once again as stationary stop member for forming of the following stacks.

The conveyor 9 comprises slats 16 (see FIGS. 3 and 4) which at a plurality of longitudinal positions are connected to and carried by chains 18 consisting of links 17. These chains 18 are deflected by deflecting members 19 with small radius of curvature and driven by tooth wheels 20 driven by a motor.

Figure 4:
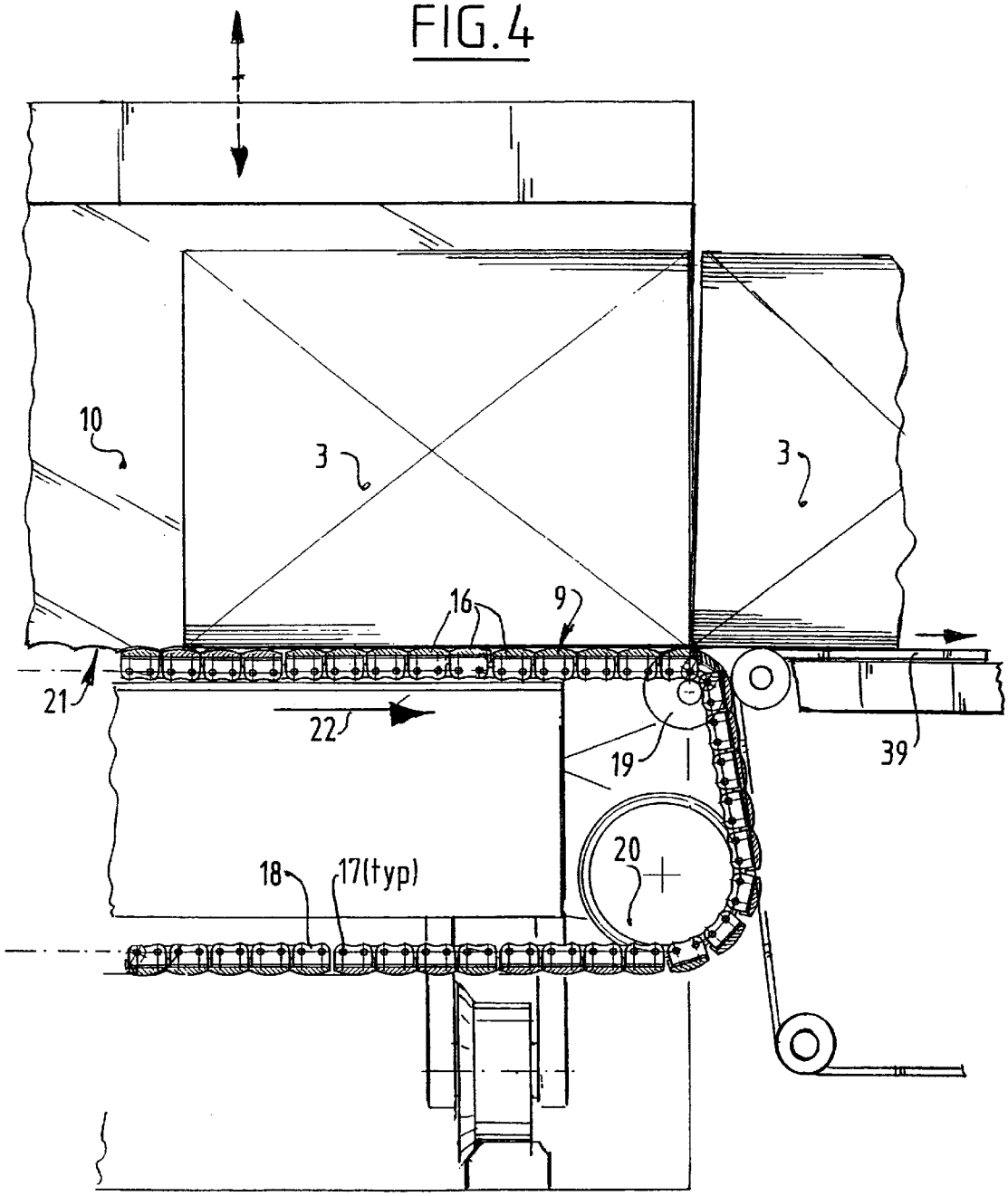
FIG. 4 shows a cross section through a part of the apparatus according to FIGS. 1, 2 and 3 on a still larger scale.

As FIG. 4 shows particularly clearly, the upper surfaces of slats 16 have a prismatic convex shape. In order to avoid the bottom board or boards of a stack not being handled correctly by stop plate 10 the bottom edge 21 of plate 10 has a shape which is complementary to the upper surface of conveyor 9.

For discharge of the stacks 3 present thereon the conveyor 9 can be driven as according to arrow 22 via the tooth wheels 20 in order to feed successive patterns of stacks 3 to a buffering and forming station 23. As will be further described hereinbelow, these stack patterns can still be radically modified by the following operation.

The feed conveyor 4 comprises two conveyor belts 30, 31 which together have a fixed length but which are mutually separated by a separating device 32 with variable position. Use is made for this purpose of respective mutually facing deflecting rollers 33 and 34 which form part of the separating device and can therefore be displaced in lengthwise direction. Situated under the active upper parts of these conveyor belts 30, 31 are the respective loops 35 and 36 of correspondingly variable lengths. The relative positioning of successively supplied boards can be adapted through the adjustability of separating device 32. A conveyor belt 37 serves to supply boards to the conveyor 9.

Figure 3:
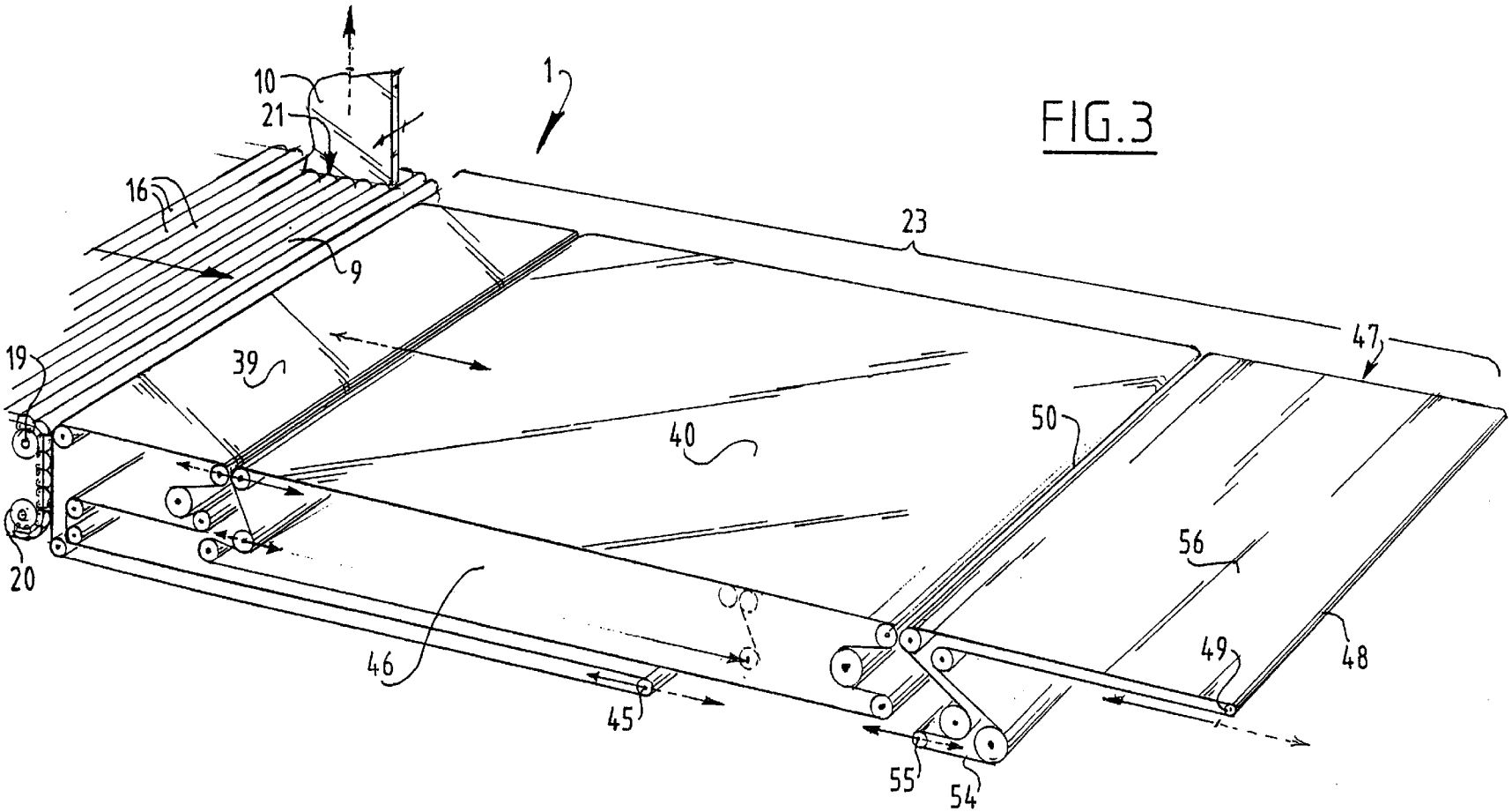
FIG. 3 is a schematic, perspective view on a further enlarged scale of a part of the apparatus of FIG. 2.

A functionally similar structure is used for the infeed conveyor belt 38 of buffering-forming station 23. This conveyor belt 38 comprises two endless conveyor belts 39, 40 mutually connecting via a separating device 41. After the description of conveyor belts 30, 31 a detailed description of conveyor belts 39, 40 will be dispensed with here. As FIG. 3 shows on enlarged scale in respect of a variant, conveyor belts 39, 40 comprise compensation loops with which the length difference occurring when separating device 41 is moved can be compensated. The conveyor belt 39 according to FIG. 1 comprises a compensation loop 42. So as to take up little space in longitudinal direction, the conveyor belt 40 according to FIG. 1 comprises two compensation loops 43, 44. In the variant of FIG. 3 the configuration differs slightly although it is functionally the same. In contrast to the intermediate loop 42 of FIG. 1, the conveyor belt 39 comprises a loop 45 located on the underside. The conveyor belt 40 comprises a single loop 46 instead of the two loops 43, 44 according to FIG. 1.

It will be apparent that the configuration and structure of the loops can be chosen in accordance with the space available and technical wishes.

A variable transfer conveyor 47 connects onto the conveyor belt 40. This former comprises an endless conveyor belt 48 of the type which can be guided through a very small radius of curvature by an end deflecting roller 49 without the conveyor belt thereby suffering damage. This aspect does not form part of the invention.

The conveyor belt 40 transfers the stacks 3 formed into a pattern via separation 50 to conveyor belt 48. This latter extends to a position above a lifting platform 51 (see FIGS. 1 and 2). This lifting platform 51, which is movable up and downward as according to arrows 52, can serve to stack on top of one another the formed and supplied patterns. For this purpose the lifting platform 51 is first placed in an upper position, wherein conveyor belt 48 is situated at a small height above roller conveyor 53. The pattern stacks 3 are then supplied to the roller conveyor 53 by the driven conveyor belt 48. When the relevant patterns are situated at a desired position thereon, the drive of conveyor belt 48 is stopped and the deflecting roller 49 is moved to the left for simultaneous movement to the left of the deflecting roller 55 arranged in the loop 54. The active upper part 56 of conveyor belt 58 is effectively shortened herein, whereby in the manner shown in FIGS. 1 and 2 the leading stack is first placed on roller conveyor 53 and subsequently the stacks located further to the rear until a full pattern rests on roller conveyor 53. The platform 51 is then moved downward through a distance roughly corresponding with the height of the stack patterns present, whereafter a following layer consisting of a pattern or arrangement of stacks is placed thereon.

For the sake of clarity of the principles according to the invention, the drawing of side guides, supports for the diverse conveyor belts, support frames in which the diverse rollers are rotatably mounted, drive motors etc. has been omitted.

As soon as a stacking of a plurality of desired layers of patterns has been realized, the support platform 51 is situated in a lowered position. The patterns stacked on top of each other can then be discharged collectively by moving lifting platform 51 upward once again to the level of a discharge roller conveyor 57. By driving the rollers of roller conveyor 53 and 57 via means which are not drawn, the formed patterns can be discharged as according to arrow 58 for further transport or handling.

Figure 2:
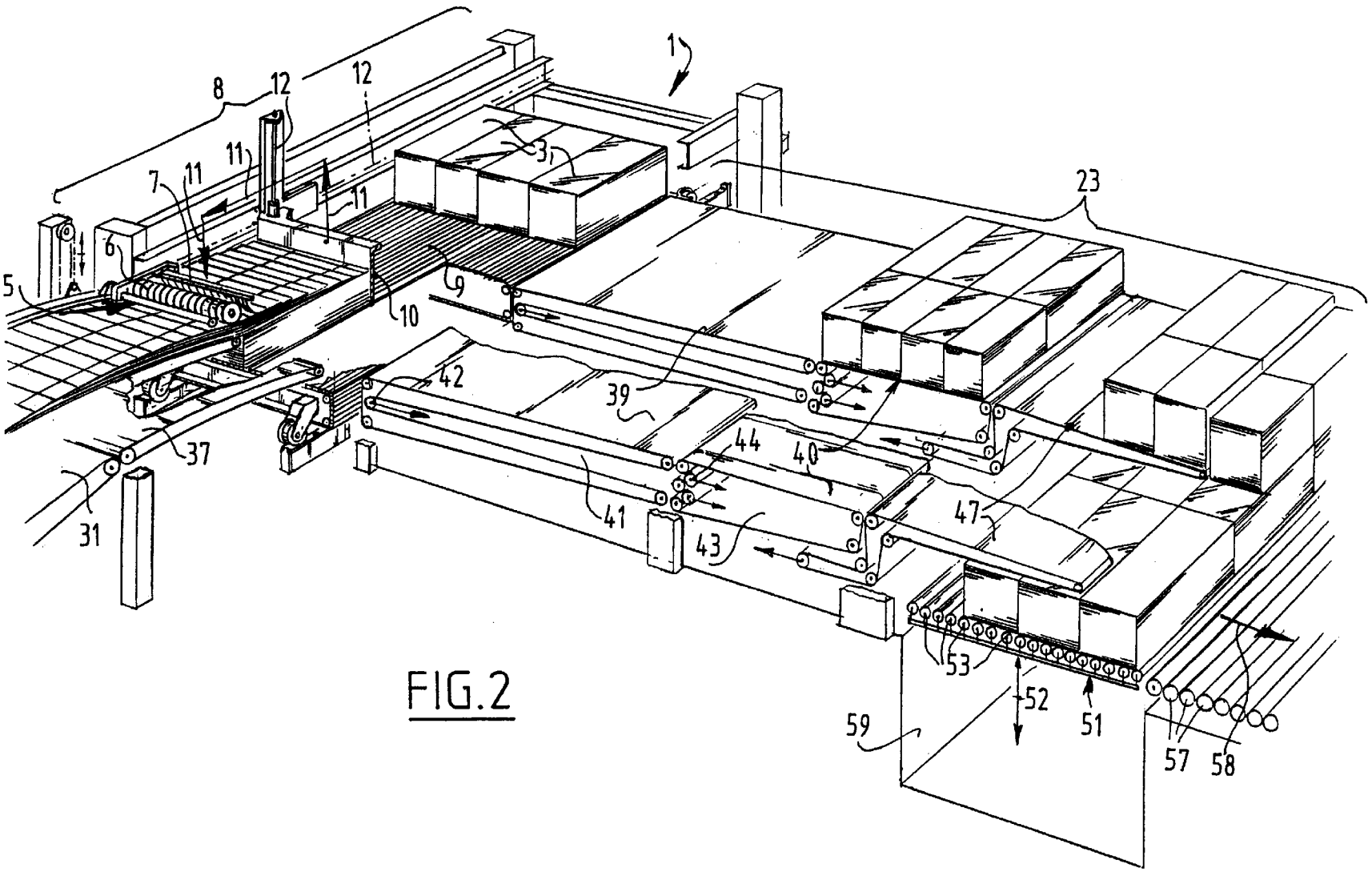
FIG. 2 shows on enlarged scale a view corresponding with FIG. 1 of a part of the apparatus of FIG. 1.

As shown in FIGS. 1 and 2, a cellar-like recessed space 59 is present in the drawn embodiment in which lifting platform 51 can be accommodated with its load. It will be apparent that the maximum stacking height which can be reached is determined by the maximum vertical distance between roller conveyor 53 and the bottom part of transfer conveyor 47. It is noted in this latter respect that, after the final transfer operation of transfer conveyor 47 in a cycle, the active part 56 thereof is as small as possible so that the stack carried by roller conveyor 53 can be displaced upward past it.

What is claimed is:

1. A stacking apparatus for successively supplying boards, forming stacks of these boards and ordering these stacks in chosen patterns, which apparatus comprises:

a feed conveyor for successively supplying boards;

a stacking station connecting onto the end of the feed conveyor and having a supporting base and a stop extending vertically and perpendicularly to a transporting direction of the feed conveyor for bringing to a standstill the boards supplied by the feed conveyor such that a stack of boards supported by the supporting base is formed;

discharge means for discharging a stack from the supporting base;

wherein the supporting base has an effective dimension in the transporting direction amounting to more than twice the dimension of the boards in the transporting direction;

the stop is drivable by drive means such that in a stationary stop position the stop can bring the supplied boards to a standstill until the thus formed stack has reached a desired height, wherein the stop subsequently is moved from the front surface of the stack to the rear surface of the stack and from this position displaces the stack by pushing over the supporting base with the stack to a position in which the rear surface of the stack lies beyond the initial position of the front surface of that stack or in which the stack lies with its front surface against the rear surface of a previously formed stack; and discharge means for removing formed stacks from the supporting base.

2. The stacking apparatus as claimed in claim 1, further including means which temporarily interrupt the supply of boards to the stacking station during the movement of the stop.

3. The stacking apparatus as claimed in claim 1, wherein the stop comprises a flat plate.

4. The stacking apparatus as claimed in claim 1, wherein the stop has a form adapted to a form of the supporting base.

5. The stacking apparatus as claimed in claim 1, wherein the supporting base is an active part of the conveyor which can discharge in a direction transverse to the transporting direction the stacks present thereon.

6. The stacking apparatus as claimed in claim 5, wherein the conveyor comprises slats hingedly coupled to each other.

7. The stacking apparatus as claimed in claim 6, wherein the slats each have a convex prismatic upper surface.

8. The stacking apparatus as claimed in claim 5, wherein the conveyor comprises a driven roller track.

9. The stacking apparatus as claimed in claim 8, wherein the stop comprises at least two elongate elements extending between the rollers.

* * * * *